US005377764A

United States Patent [19]

Jennings, Jr.

[11] Patent Number: 5,377,764

[45] Date of Patent: * Jan. 3, 1995

[54] MEANS OF INJECTING $CO_2$ INTO CIRCULATION TUBING TO FACILITATE $CO_2$ GAS LIFT

[75] Inventor: Alfred R. Jennings, Jr., Plano, Tex.

[73] Assignee: Mobile Oil Corporation, Fairfax, Va.

[ * ] Notice: The portion of the term of this patent subsequent to Aug. 16, 2011 has been disclaimed.

[21] Appl. No.: 992,667

[22] Filed: Dec. 18, 1992

[51] Int. Cl.[6] ..... F21B 43/00

[52] U.S. Cl. ..... 166/372; 166/53

[58] Field of Search ..... 166/372, 53

[56] References Cited

U.S. PATENT DOCUMENTS

| | | | |
|---|---|---|---|
| 2,881,838 | 4/1959 | Morse et al. | 166/40 |
| 3,155,160 | 11/1964 | Craig, Jr. et al. | 166/40 |
| 3,259,186 | 7/1966 | Dietz | 166/11 |
| 4,257,560 | 3/1981 | Diamond | 239/337 |
| 4,267,885 | 5/1981 | Sanderford | 166/372 X |
| 4,420,008 | 12/1983 | Shu | 137/4 |
| 4,756,369 | 7/1988 | Jennings, Jr. et al. | 166/272 |
| 5,211,242 | 5/1993 | Coleman et al. | 166/372 |

*Primary Examiner*—William P. Neuder

*Attorney, Agent, or Firm*—Alexander J. McKillop; George W. Hager, Jr.; Charles A. Malone

[57] ABSTRACT

A method for removing a viscous hydrocarbonaceous fluid or oil from a formation where carbon dioxide is utilized. Gaseous carbon dioxide is injected, by a pre-set time interval or a computer actuated valve means, into a well near a productive interval. Injection continues for a time sufficient for the carbon dioxide and oil to mix thereby decreasing the oil's viscosity and facilitating gas lift of an oil of reduced viscosity to the surface.

17 Claims, 2 Drawing Sheets

MEANS OF INJECTING $CO_2$ INTO CIRCULATION TUBING TO FACILITATE $CO_2$ GAS LIFT

FIELD OF THE INVENTION

This invention is related to methods for removing a viscous hydrocarbonaceous fluid from a wellbore located in a subterranean formation.

BACKGROUND OF THE INVENTION

High viscosity heavy oil constitutes one of the major remaining oil resources in North America. Since the oil is too viscous to flow under reservoir conditions, steam injection and steam-flooding have provided a means to thin the oil with high temperature steam so as to allow production increases. When steam-flooding in a heavy oil reservoir, steam is injected into selected injection wells and the thin oil is produced from production wells.

The capability to produce the heavy oil in production wells is dependent upon the ability to keep the heavy oil at a high enough temperature so as to cause the oil to be thin enough to flow. Because of heterogeneities in the reservoir, fluctuations in surface temperatures, and compositions of fluids produced, production may slow sufficiently so as to allow a cool down and thickening of produced oil.

Therefore, what is needed is a method to keep heavy viscous oils sufficiently warm and thin so as to enable them to be produced to the surface in an easy manner.

SUMMARY OF THE INVENTION

This invention is directed to a method for facilitating the removal of a viscous hydrocarbonaceous fluid from a wellbore. Initially, oil is produced into a well from a productive interval of a formation containing a viscous or heavy oil. As the oil flows into the well, gaseous carbon dioxide is introduced into the oil in the well substantially near the productive interval. Flow of the carbon dioxide entering the well is such as to cause a mixing effect with the oil. Flow into the well is controlled by a pre-set timer or by an electronically actuated control valve connected to a computer or microprocessor that is connected to an oil production monitoring assembly. This monitoring assembly is set so as to maintain a desired specific gravity and viscosity of oil produced from the well. When the specific gravity or viscosity changes to an undesired level, the computer actuates the control valve to obtain a desired quantity and quality of oil. When the specific gravity is too high, the computer senses this change and additional carbon dioxide is directed into the well.

Upon mixing with the oil, carbon dioxide and oil commingle thereby causing the oil to become lessened in specific gravity and reduced in viscosity. When oil entering the well contains steam, the carbon dioxide will expand thereby facilitating gas lift. Thereafter, oil of reduced viscosity is produced to the surface.

It is therefore an object of this invention to provide for an adaptable method for recovering viscous hydrocarbonaceous fluids from wellbores located at various depths and locations.

It is another object of this invention to provide for uniform temperatures in the wellbore during the production of hydrocarbonaceous fluids.

It is yet another object of this invention to provide for a method which simplifies clean-out of the wellbore in the event of a shutdown by facilitating the removal of hydrocarbonaceous fluids.

It is a further object of this invention to provide for a means for automatically adjusting carbon dioxide circulation flow rates within a wellbore to maximize heavy oil production.

It is another further object of this invention to facilitate lifting of water from a wellbore by lowering the surface tension of the water via the creation of carbonic acid with said water and carbon dioxide.

PREFERRED EMBODIMENTS

Figure 1:
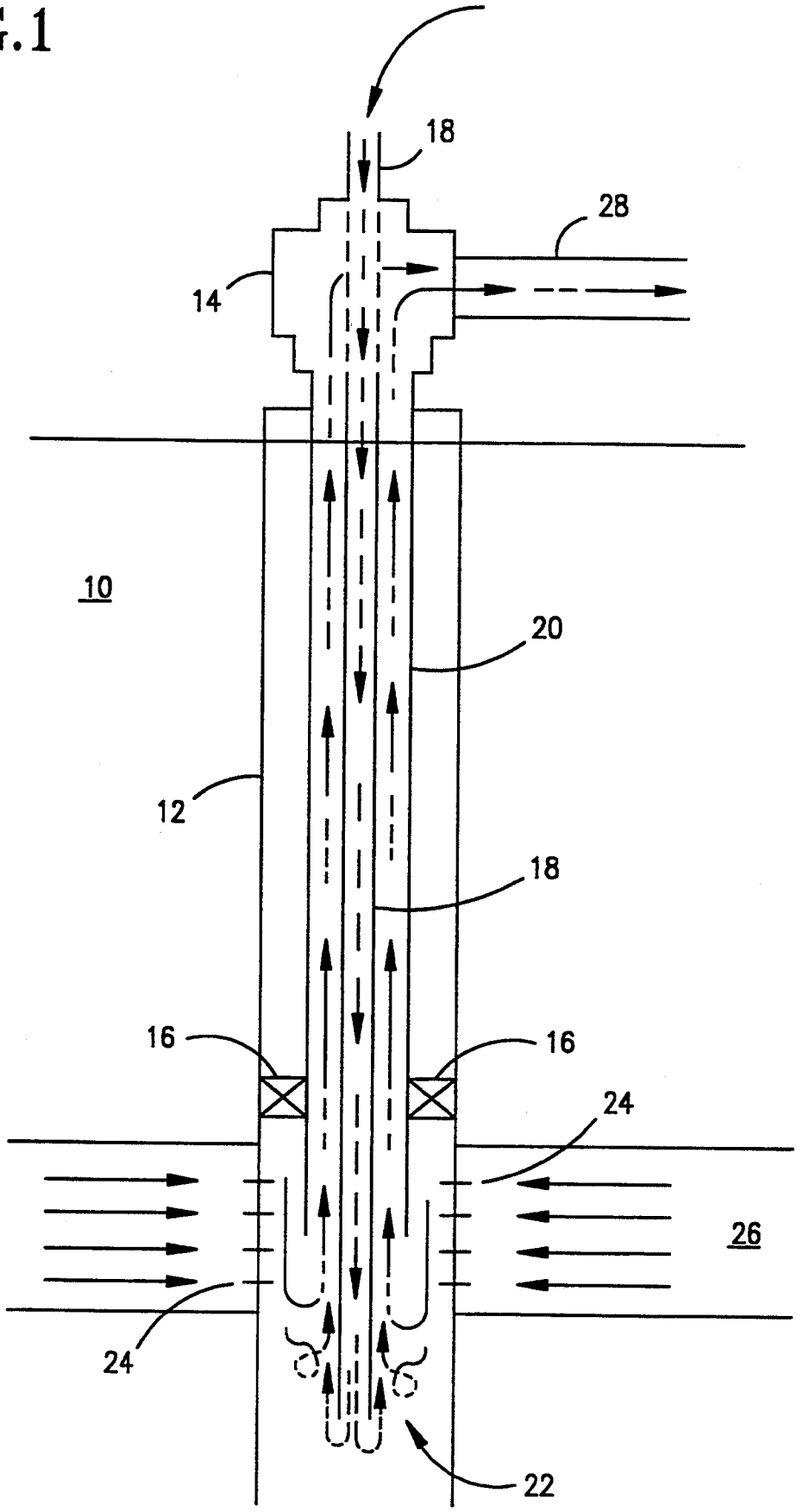
FIG. 1 is a schematic representation which depicts use of gaseous carbon dioxide to enhance heavy oil recovery within a wellbore.

In the practice of this invention, referring to FIG. 1, gaseous carbon dioxide is directed down injection tubing 18 where it enters production well 12 and mixes with heavy oil or hydrocarbonaceous fluids contained in mixing area 22. In this embodiment, a timer set to a desired interval is used to inject a desired amount of gaseous carbon dioxide into injection tubing 18. When this method is used, a history of data obtained from well production can be used to determine the amount of carbon dioxide needed to maintained a desired specific gravity or viscosity for a desired production rate.

Figure 2:
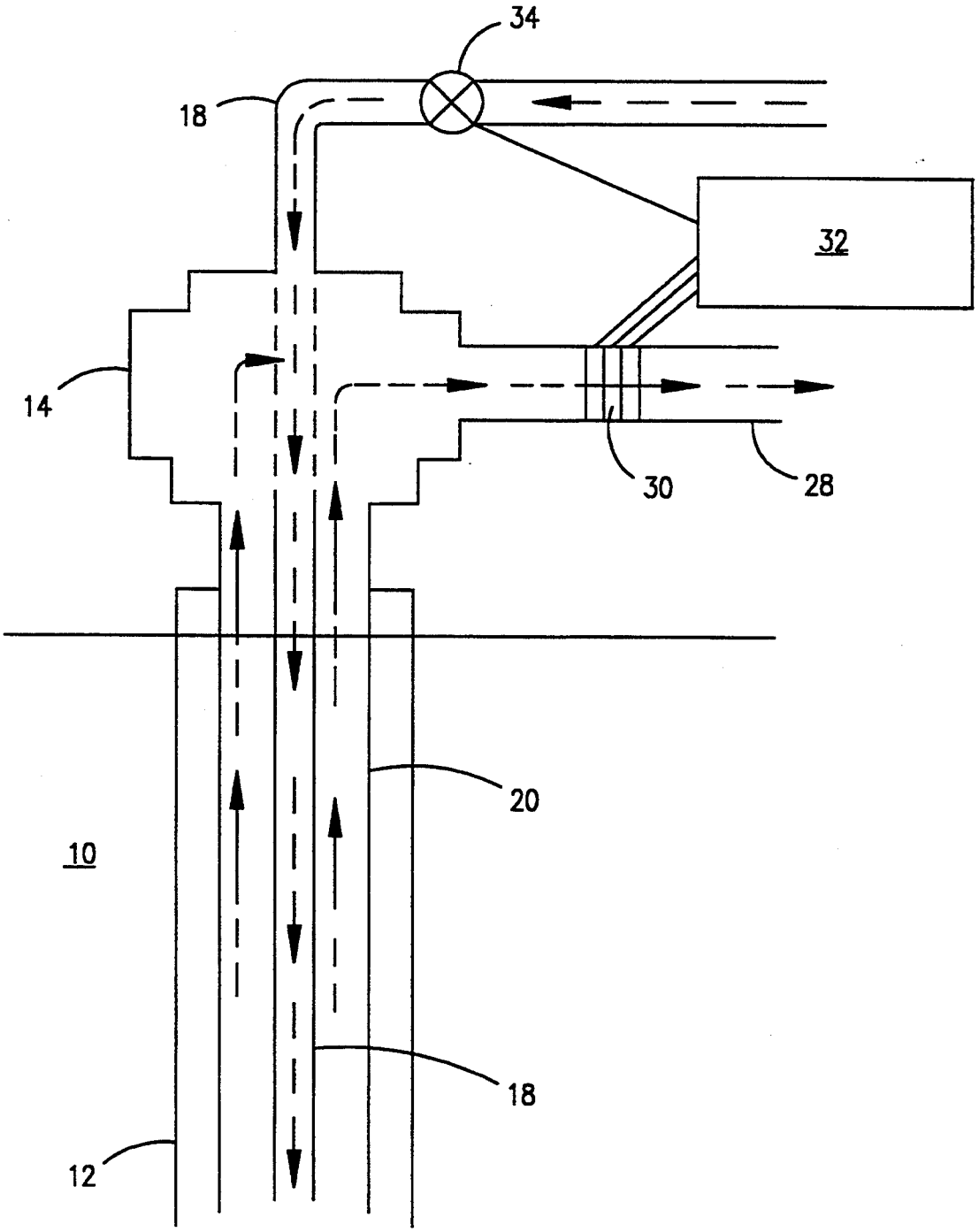
FIG. 2 is a schematic representation which depicts a computer connected to a monitoring assembly and an electronically actuated control valve so as to control the quantity and quality of produced oil through automated carbon dioxide injection.

In another embodiment, referring to FIG. 2, monitoring assembly 30 is placed within conduit 28. This monitoring assembly is connected electrically to computer or microprocessor 32 which is connected electrically to electronically actuated control valve 34. Monitoring assembly 30 contains a temperature sensing means, a specific gravity detection means, a flow detection means, and a viscosity detection means. These detection and sensing means are set at predetermined points so as to maintain a desired quantity and quality of oil production from the productive interval. The temperature sensing means is needed to determine the specific gravity, viscosity, and accurate flow rates. Once the viscosity and specific gravity are set as desired, a desired level or flow of oil from the productive interval can be maintained. Control of oil flow from the formation is obtained by using the pre-set specific gravity and viscosity levels to automatically inject gaseous carbon dioxide down injection tubing 18. Electric signals directed from monitoring assembly 30 are directed to computer 32. When the computer detects a departure from the pre-set specific gravity and viscosity levels, the computer sends a signal to control valve 34 thereby actuating it. Actuating control valve 34 causes it to open or close and control the amount of gaseous carbon dioxide that will be directed into injection tubing 18 and thereafter into mixing area 22. By controlling carbon dioxide injection, specific gravity and viscosity are controlled to maintain gas lift and a desired production level.

A method for transporting viscous crude oils where a computer is used to control specific gravity and viscosity for crude flow control is described in U.S. Pat. No. 4,420,008 which to Shu on Dec. 13, 1983. This patent is hereby incorporated by reference herein. Utilization of the teachings described therein will enable one skilled in the art to use a computer or microprocessor to maintain a desired specific gravity and viscosity for controlling the amount of gaseous carbon dioxide to be directed down the injection tubing.

Injection tubing 18 is located centrally within wellhead 14 which terminates into a tubing having an end thereof which is positioned centrally within the well. The end of this tubing terminates within the well at productive interval 26 of formation 10. This productive interval communicates fluidly with production well 12 by perforations 24. Since injection tubing 18 is centrally located within the tubing connected to wellhead 14, a concentric production tubing 20 is formed around the injection tubing by the annulus formed therebetween. Production tubing 20 fluidly communicates so as to remove fluids in the productive interval to the surface via the wellhead where production tubing 20 terminates. Wellhead 14 has as opening therein to which conduit 28 is attached that directs any produced fluids away from the well after being produced to the surface. Injection tubing 18 is positioned in well 12 and wellhead 14 so as to terminate below productive interval 26 and the end of production tubing 20.

In order to maintain production tubing 20 in a stationary position, a production packer 16 is placed around the production tubing. Wellbore 12 is in fluid communication with productive interval 26 via perforations 24. Being in fluid communication with productive interval 26 allows a hydrocarbonaceous fluid mixture to flow into wellbore 12.

Hydrocarbonaceous fluids which flow into the mixing area 22 of wellbore 12 are of a heavy or high viscosity. Heavy or high viscosity oils are herein identified as those which have an API gravity of less than about 19 degrees. To facilitate the removal of these heavy hydrocarbonaceous fluids from well 12, gaseous carbon dioxide is directed or injected via a pre-set timer or computer down injection tubing 18 at a force and rate sufficient to flow into mixing area 22 where it mixes with heavy hydrocarbonaceous fluids to maintain a desired specific gravity or viscosity. This mixing causes a reduction in the specific gravity and viscosity of the heavy hydrocarbonaceous fluids that makes it easier to lift the fluids to the surface. The gaseous carbon dioxide is injected intermittently, by a pre-set time interval or computer means, in slugs down injection tubing 18. In yet another embodiment, heavy hydrocarbonaceous fluids entering wellbore 12 via productive interval 26 are mixed with steam as the result of a steam-flooding operation. This steam-flooding operation can be undertaken by injecting steam into a separate spaced apart injection well for production to the surface by a production well. Alternatively, it can be conducted as a "huff and puff" steam-flood operation in one well. When steam is used in a single well for hydrocarbonaceous fluid production, the technique is known as a "huff and puff" method. This method is described in U.S. Pat. No. 3,259,186 which is hereby incorporated by reference herein. In this method, steam is injected via a well in quantities sufficient to heat the subterranean hydrocarbon-bearing formation in the vicinity of the well. The well is then shut-in for a soaking period, after which it is placed on production. After production has declined, the "huff and puff" method may again be employed on the same well to again stimulate production.

The application of single well schemes employing steam injection as applied to heavy oils or bitumen is described in U.S. Pat. No. 2,881,838, which utilizes gravity drainage. This patent is incorporated by reference herein. An improvement of this method is described in a later patent, U.S. Pat. No. 3,155,160, in which steam is injected and appropriately timed while pressuring and depressurizing steps are employed. Where applicable to a field pattern, the "huff and puff" technique may be phased so that numerous wells are on an injection cycle while others are on a production cycle; the cycles may then be reversed. This patent is hereby incorporated by reference herein.

U.S. Pat. No. 4,257,560, describes a method for recovering high viscosity oils from subsurface formations using steam and an inert gas to pressurize and heat the formation along with the oil it contains. U.S. Pat. No. 4,756,369 describes a use of carbon dioxide in the presence of steam in heavy oil reservoirs to enhance the mobility of heavy oil therein. These patents are hereby incorporated by reference herein.

Once oil or hydrocarbonaceous fluids containing the steam enter well 12, gaseous carbon dioxide is injected intermittently, by a pre-set time interval or a computer actuated valve means, down injection tubing 18 into mixing area 22 substantially near productive interval 26 where they commingle. As hot oil containing steam contacts gaseous carbon dioxide, this gas expands and aids in lifting thinned oil and water to the surface via production tubing 20. Some of the carbon dioxide is solubilized in the heavy oil thereby thinning it and facilitating its production to the surface. Lifting of water entrained in the oil is made easier due to the lower surface tension of carbonic acid (carbon dioxide in water) formed by a limited solubility of carbon dioxide in the produced water.

Intermittent or continuous injection of carbon dioxide into mixing area 22 helps to keep mixing area 22 at a fairly constant temperature and thereby improves the production of hydrocarbonaceous fluids to the surface. As is understood by those skilled in the art, gaseous carbon dioxide injection into the mixing area will depend upon formation conditions existing in a particular wellbore. In any event, the amount of gaseous carbon dioxide circulation or injection into mixing area 22 should be an amount sufficient to pressurize the oil and reduce the viscosity of the heavy oil or viscous hydrocarbonaceous fluid to an extent sufficient to improve gas lifting of the oil of reduced viscosity to the surface. Once sufficient gaseous carbon dioxide has been injected into the well to maintain gas lift and viscosity reduction, carbon dioxide injection is ceased. When gas lift is insufficient to maintain a desired production level, carbon dioxide is again commenced.

Once the hydrocarbonaceous fluid, carbon dioxide, and water mixture is produced to the surface, it is directed into a vessel so as to allow separation of the hydrocarbonaceous fluids from the carbon dioxide and water. Separated carbon dioxide can be recycled into the productive interval to recover additional hydrocarbonaceous fluids.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for removing a heavy or viscous hydrocarbonaceous fluid from a formation comprising:

a) flowing oil from a productive interval of a formation into a well; and b) injecting gaseous carbon dioxide by a pre-set time interval or a computer actuated valve means into said well near said productive interval for a time sufficient for the carbon dioxide and hydrocarbonaceous fluid to mix thereby decreasing the fluid's viscosity and facilitating gas lift of a fluid of reduced viscosity to the surface.

2. The method as recited in claim 1 where the well is a production well.

3. The method as recited in claim 1 where gaseous carbon dioxide is injected into said well by an injection tubing.

4. The method as recited in claim 1 where gaseous carbon dioxide is removed from said well by a production tubing.

5. The method as recited in claim 1 where gaseous carbon dioxide is injected into said well in even or timed increments.

6. The method as recited in claim 1 where said hydrocarbonaceous fluid is flowed into the productive interval as a result of a steam-flooding enhanced oil recovery operation.

7. The method as recited in claim 1 where lifting of water in said well is facilitated because of a reduction in the surface tension thereof due to the creation of carbonic acid.

8. A method for removing a heavy or viscous hydrocarbonaceous fluid from a formation comprising:

a) flowing oil from a productive interval of a formation into a well which oil is intermixed with steam; and b) injecting gaseous carbon dioxide by a pre-set time interval or a computer actuated valve means into said well near said productive interval for a time sufficient for the carbon dioxide and hydrocarbonaceous fluid to mix thereby decreasing the fluid's viscosity, pressurizing said fluid, and facilitating gas lift of a fluid of reduced viscosity to the surface.

9. The method as recited in claim 8 where the well is a production well.

10. The method as recited in claim 8 where gaseous carbon dioxide is injected into said well by an injection tubing.

11. The method as recited in claim 8 where gaseous carbon dioxide is removed from said well by a production tubing.

12. The method as recited in claim 8 where gaseous carbon dioxide is injected into said well in even or timed increments.

13. The method as recited in claim 8 where lifting of water in said well is facilitated because of a reduction in the surface tension thereof due to the creation of carbonic acid.

14. A method for removing a heavy or viscous hydrocarbonaceous fluid from a formation comprising:

a) flowing oil from a productive interval of a formation into a well which oil is intermixed with steam; and b) injecting into an injection tubing gaseous carbon dioxide by a pre-set time interval or a computer actuated valve means into said well near said productive interval for a time sufficient for the carbon dioxide and hydrocarbonaceous fluid to mix thereby decreasing the fluid's viscosity, pressurizing said fluid, and facilitating gas lift of a fluid of reduced viscosity to the surface by a production tubing.

15. The method as recited in claim 14 where said hydrocarbonaceous fluid is flowed into the productive interval as a result of a steam-flooding enhanced oil recovery operation.

16. The method as recited in claim 14 where lifting of water in said well is facilitated because of a reduction in the surface tension thereof due to the creation of carbonic acid.

17. The method as recited in claim 8 where said hydrocarbonaceous fluid is flowed into the productive interval as a result of a steam-flooding enhanced oil recovery operation.

* * * * *